US005110000A

United States Patent [19]

Nichols

[11] Patent Number: 5,110,000

[45] Date of Patent: May 5, 1992

[54] COMPOSITE SHIPPING CONTAINER WITH SEPARABLE TOP AND BOTTOM STRUCTURES

[75] Inventor: Dwight E. Nichols, Beatrice, Nebr.

[73] Assignee: Hoover Group, Inc., Alpharetta, Ga.

[21] Appl. No.: 653,359

[22] Filed: Feb. 11, 1991

[51] Int. Cl.[5] ..... B65D 19/00

[52] U.S. Cl. ..... 220/4.16; 220/1.5; 220/4.09; 220/461; 220/403

[58] Field of Search ..... 220/306, 1.5, 403, 4.16, 220/4.09, 4.08, 485, 494, 461

[56] References Cited

U.S. PATENT DOCUMENTS

| | | | |
|---|---|---|---|
| 3,515,302 | 6/1970 | Curran | 220/306 |
| 3,900,129 | 8/1975 | Scholz | 220/306 |
| 3,964,636 | 6/1976 | Rehrig | 220/306 |
| 4,166,549 | 9/1979 | Schutz et al. | 220/319 |
| 4,431,113 | 2/1984 | Sims, Jr. | 220/306 |
| 4,550,830 | 11/1985 | Shuert | 206/386 |
| 4,666,059 | 5/1987 | Nordstrom | 220/465 |
| 4,673,087 | 6/1987 | Webb | 206/511 |
| 4,765,252 | 8/1988 | Shuert | 108/55.1 |
| 4,793,519 | 12/1988 | Voorhies, Jr. | 220/465 |
| 4,850,506 | 7/1989 | Heaps, Jr. et al. | 220/403 |
| 4,903,853 | 2/1990 | Lin | 220/485 |
| 4,909,387 | 3/1990 | Schutz | 220/485 |
| 4,930,661 | 6/1990 | Voorhies | 220/1.5 |
| 4,947,988 | 8/1990 | Schutz | 220/485 |
| 5,002,194 | 3/1991 | Nichols | 220/1.5 |

FOREIGN PATENT DOCUMENTS

| | | | |
|---|---|---|---|
| 3826466 | 2/1990 | Fed. Rep. of Germany | 220/485 |

*Primary Examiner*—Stephen P. Garbe
*Assistant Examiner*—S. Castellano

[57] ABSTRACT

A shipping container having an inner tank, a housing and a pallet. The tank is made of poly material and is positioned and supported within the housing on the pallet. The housing includes upright side walls which maintain the tank side walls in an upright position and further includes a top structure and bottom structure. The bottom structure is attached to the pallet and assists the pallet in supporting the weight of the tank. Both the top and bottom structures incorporate features which allow them to self engage the upper and lower periphery ends of the side walls upon relative telescoping movement between the top and bottom structures and the side walls. This engagement is releasable and generally allows the housing to be quickly and securely snapped together.

23 Claims, 4 Drawing Sheets

COMPOSITE SHIPPING CONTAINER WITH SEPARABLE TOP AND BOTTOM STRUCTURES

BACKGROUND AND SUMMARY OF THE INVENTION

The invention relates to bulk liquid shipping containers. More particularly, the invention a composite shipping container includes an outer container that encloses a synthetic resin inner tank. The top and bottom structures of the outer container are provided with an attaching mechanism that connect to the side walls of the outer container.

An example of a composite shipping container known within the industry is disclosed in U.S. Pat. No. 4,793,519, which is commonly assigned to the Assignee of the present application. In general, these composite shipping containers comprise an outer container of sheet metal or corrugated paper and enclose a synthetic resin or poly tank. The inner tank is filled with a liquid or another bulk material and is maintained in its upright position by the outer container. Both the outer container and inner tank may be supported on a pallet member having a support surface specifically for that purpose.

However, these prior composite shipping containers have exhibited various limitations. One limitation is that the containers are difficult or impossible to disassemble once the liquid contained therein has been discharged. Following from this it can be seen that the prior containers do not readily lend themselves to reuse (the inner tank must be cleaned) or recycling (non-compatible materials must be separated). Another limitation is that if a portion of the container became damaged, the entire container was discarded.

With the limitations of the prior art in mind, it is an object of the present invention to provide a composite shipping container which is readily assembled and disassembled to facilitate the recycling and/or reuse of its major components.

It is another object of the invention to provide a composite shipping container wherein the top and/or bottom structures of the outer container are readily assembled with the side walls of the outer container.

It is a further object of this invention to provide a composite shipping container having a modular assembly in which the major subassemblies can be easily replaced if damaged.

It is an additional object of the invention to provide a composite shipping container in which the container's subassemblies allow for other containers to be easily re-manufactured for compatibility therewith and subsequent reuse.

In achieving the above-mentioned objects, a composite shipping container is provided wherein the top and bottom structures of the outer container are provided with engaging mechanisms that enable them to securely attach to the body or side walls of the outer container to enclose and support the inner tank. The bottom structure of member of the outer container is secured to a pallet which may include openings for fork lift tines allowing the shipping container to be easily manipulated and handled. The side walls of the outer container engage the bottom member along their lower periphery. Once engaged, the side walls are retentively secured by the bottom member and permit the inner tank to be positioned in the outer container and supported thereby.

The top structure or wall of the outer container is lowered onto the upper periphery of the outer container side walls. In a manner similar to the bottom member, the top wall engages the upper periphery of the side walls and is retained thereon.

The inner tank may now be filled with a bulk liquid material and shipped to the consumer. Upon the inner tank being emptied, the composite shipping container of the present invention is readily disassembled.

The top wall and bottom member may be disengaged from the side walls by merely providing a force which is sufficient to overcome the retaining force. With the top wall removed the inner tank may be removed from the outer container and discarded, recycled or cleaned for reuse. If one of the subassemblies has become damaged, for example the top wall, it can be readily replaced. After disassembly, the outer container can be sent back to the original supplier in a space conserving size for subsequent reuse.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE ILLUSTRATED EMBODIMENT

Figure 1:
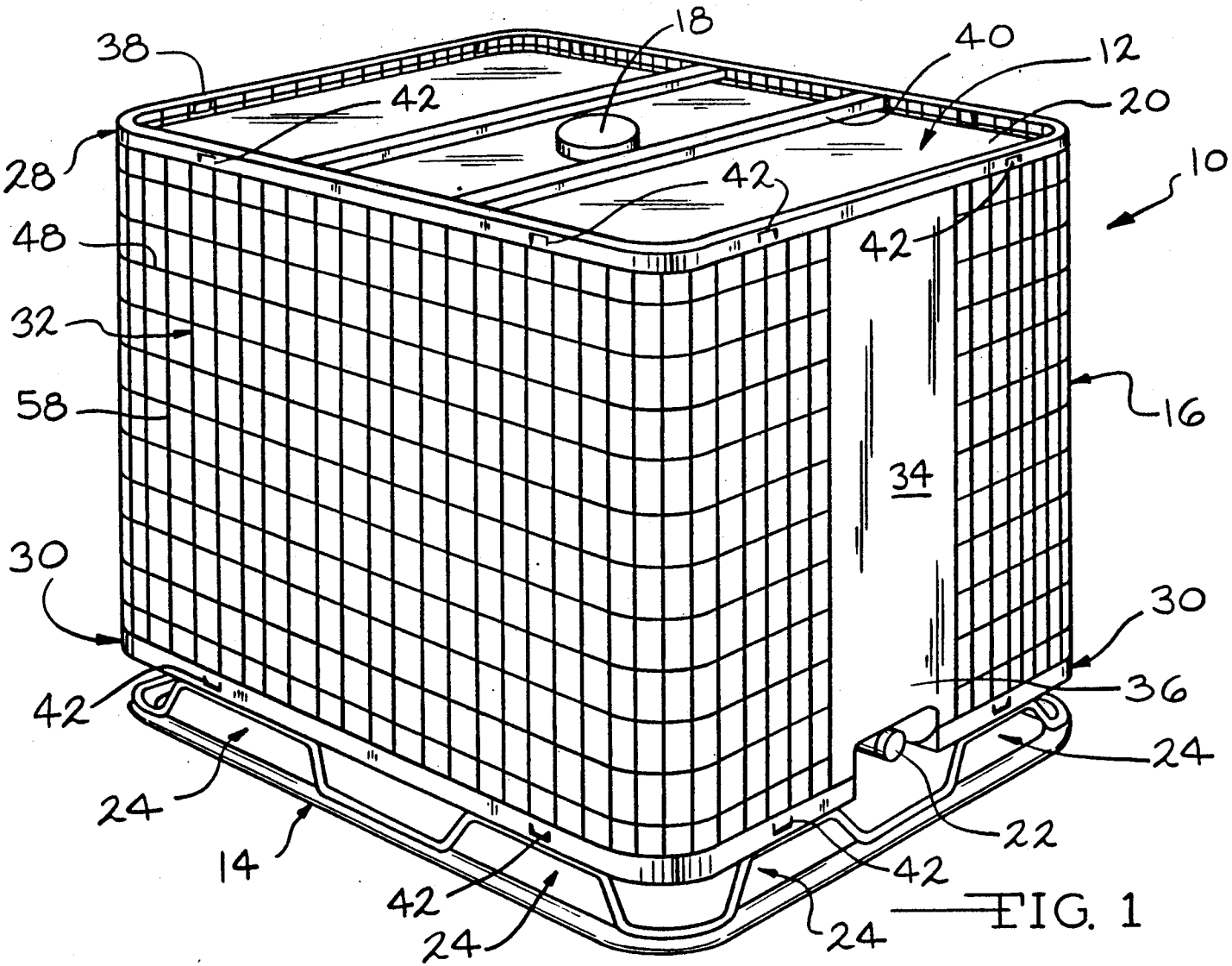
FIG. 1 is a perspective view of a composite shipping container embodying the principles of the present invention.

Referring now to FIG. 1, the composite shipping container of the present invention is generally designated at 10 and includes an inner tank 12 which is supported on a pallet 14 and enclosed within an outer container or housing 16.

The inner tank 12 is generally of a unitary construction and is blow molded from a synthetic resin so as to have substantially thin side walls. As such, the tank's side walls are incapable of supporting the tank 12 in an upright position. Tanks 12 of this type are well known within the industry and are typically made from high density polyethylene (HDPE) and referred to as poly tanks. The tank 12 also typically includes a fill opening or port 18 located in the top wall 20 and a discharge opening or port 22 located in one of the side walls adjacent to the bottom wall of the tank 12 or actually in the bottom wall itself.

As mentioned above, the tank 12 is supported on an uppermost support surface 26 (FIG. 2) of pallet 14. The pallet 14 may be a wooden pallet or a metal pallet and may include openings 24 which will allow for the insertion of fork lift tines to manipulate the shipping container 10. In the preferred embodiment, the pallet 14 is made of metal and incorporates a truss construction.

The housing 16 rests upon the upper surface 26 of the pallet 14 and generally includes a top structure or wall 28, a bottom member or structure 30 and substantially upright side walls 32. The bottom member 30 is attached to the pallet 14. While the pallet 14 may be constructed in numerous ways, in the preferred embodiment, the bottom member 30 of the housing 16 is welded to the pallet 14 so as to integrally form a part of the support surface 26. If a wooden pallet 14 is used, the bottom member 30 may be nailed or screwed thereonto.

Figure 2:
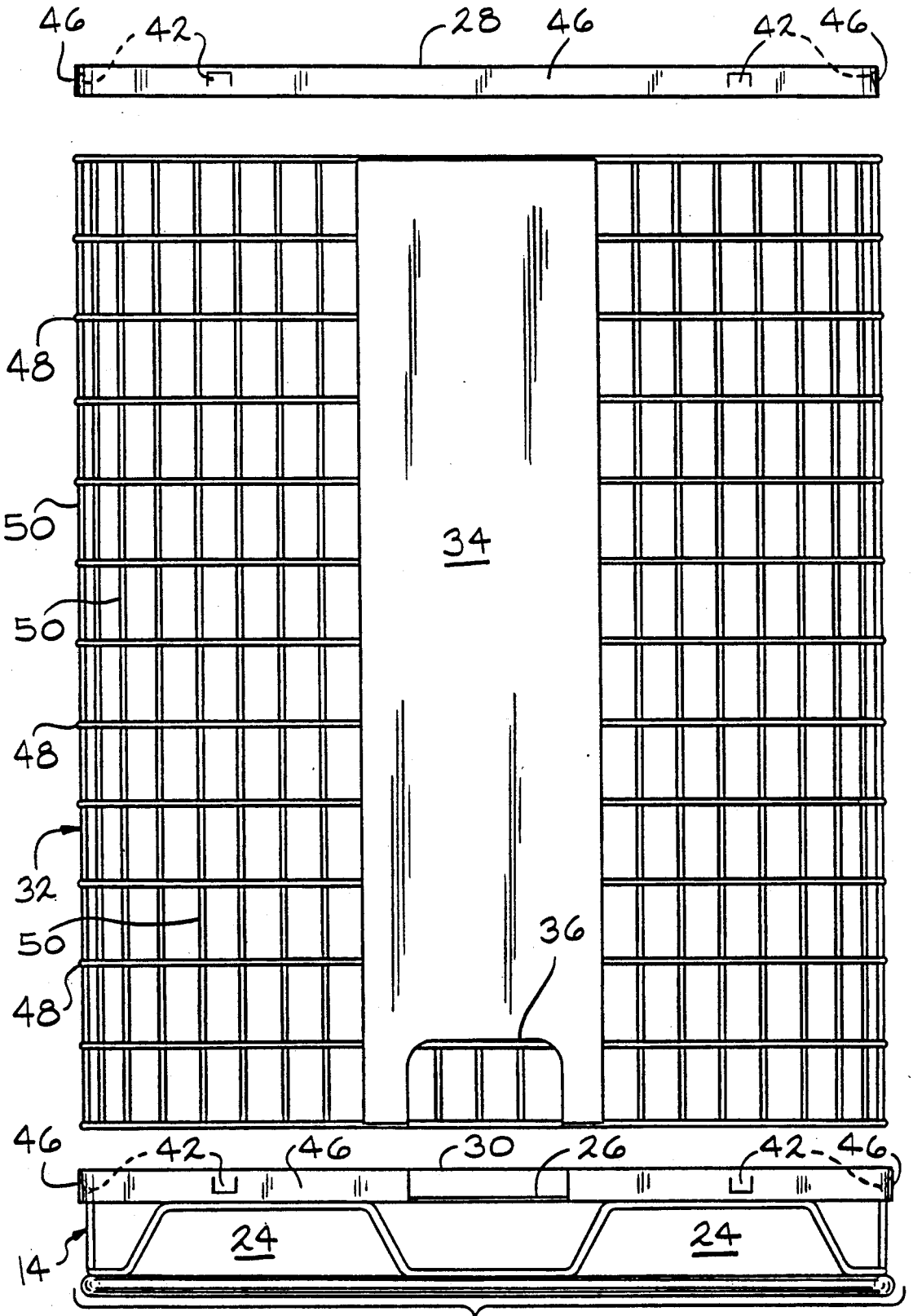
FIG. 2 is an exploded front elevational view of the shipping container seen in FIG. 1.

As more fully described below, the side walls 32 are attached at their lower periphery to the bottom member 30 along the perimeter of the support surface 26 in a releasable and generally, self-engaging manner. The side walls 32 can be constructed from fiber board, galvanized sheet metal, wire or tubular mesh, and other similar materials and can have any desired finish. In the preferred embodiment, the side walls 32 are constructed of a flexible wire mesh which is flexible enough to allow the wire mesh to be wrapped around the side walls of the inner tank 12. As seen in FIGS. 1 and 2, the opposing ends of the side wall 32 are joined and secured together by a splice plate 34. While the splice plate 34 may be positioned along any of the side walls 32, in the present invention it is positioned so as to have a lower portion defining an access opening 36 corresponding to the tank's discharge port 22. The size of the splice plate 34 may be varied to allow for markings, such as the contents or safety warnings, to be displayed on the container 10.

In a manner similar to the bottom member 30, the top wall 28 is secured to the upper periphery of the side walls 32. In the preferred embodiment, the top wall 28 utilizes a strut 40 and circumferential member 38 construction. Alternatively, the top wall 28 can have a plate or solid wall construction, so long as an opening is provided for the fill port 18 of the inner tank 12.

A major feature of this new composite shipping container 10 is the manner in which the top wall 28 and bottom member 30 are attached to the side walls 32. In joining the top wall 28 and bottom members 30 to the side walls 32, a generally self-engaging or snap-together assembly is utilized. Two embodiments of the assembly are illustrated in FIGS. 3–6. The assembly is referred to as being generally self-engaging because the attachment is operable upon relative telescopic movement between either the side walls 32 and the top wall 28 or bottom member 30. The first of the two embodiments incorporates biased tabs 42, while the second employs a frictional engagement, the structure of which is hereinafter referred to as a "T-angle" 44.

Figure 3:
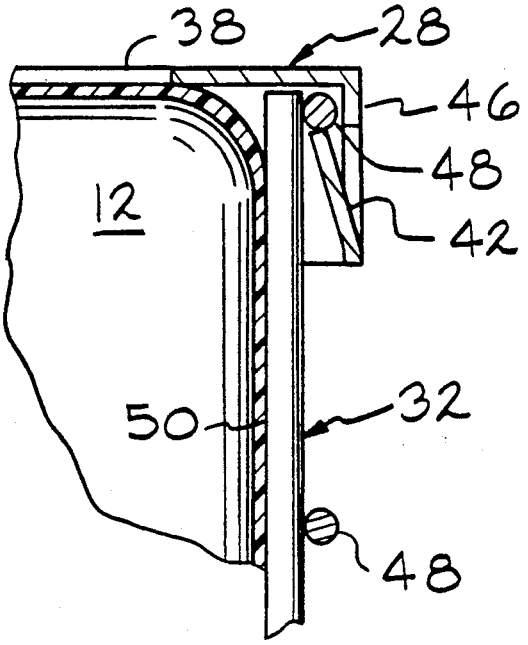
FIG. 3 is a sectional view.of a portion of the shipping container illustrating one embodiment of the top wall engaging a side wall as provided for by the present invention.
Figure 4:
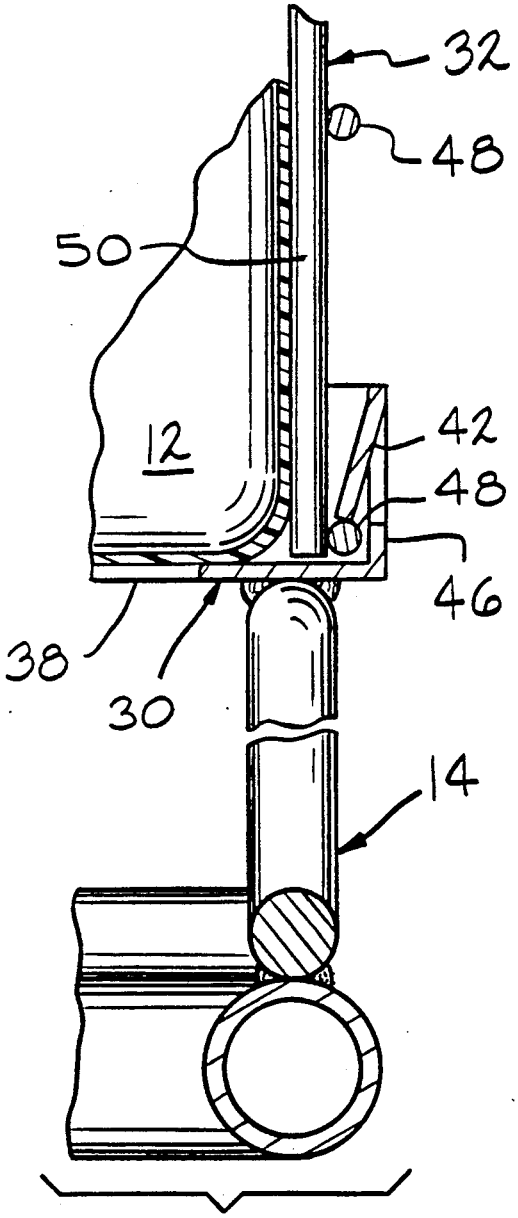
FIG. 4 is a sectional view of a portion of the shipping container illustrating one embodiment of the bottom member engaging a side wall as provided for by the present invention.

As seen in the embodiment of FIGS. 3 and 4, the bottom member 30 and the circumferential member 38 of the top wall 28 are constructed with an angled perimeter. As such, each includes a generally vertical or upright flange 46 along its perimeter. The biased tabs 42 are positioned along the upright flanges 46 of the top wall 28 and bottom member 3 and are integrally formed as cut out sections. This provides the invention with a simplified manufacturing techniques. The tabs 42 are biased inward from the flanges 46, toward the inner tank's 12 position, and extend generally upward in the top member 28 and downward in the bottom member 30.

The bias tabs 42 are specifically designed to be used with the wire mesh side walls 32 illustrated in FIG. 1, however other side wall constructions could also be used. Being constructed of wire mesh, the side walls 32 exhibit a criss-crossed or latice network of lateral or cross wires 48 and upright wires 50. When engaging the top wall 28 and bottom member 30 with the side walls 32, the upper and lowermost cross wires 48 will correspondingly deflect the tabs 42 against their biasing until the tabs 42 "snap over" the cross wires 48 locking the side walls 32 into engagement. As readily seen in the drawings, the tabs 42 form a positive interference engagement with a surface of the cross wires 48 and prevent withdrawal or disengagement thereof. To disengage the side walls 32 from the top wall 28 and bottom member 30, the tabs 42 need only be deflected against their biasing an amount which will allow the cross wires 48 to pass thereby.

Figure 5:
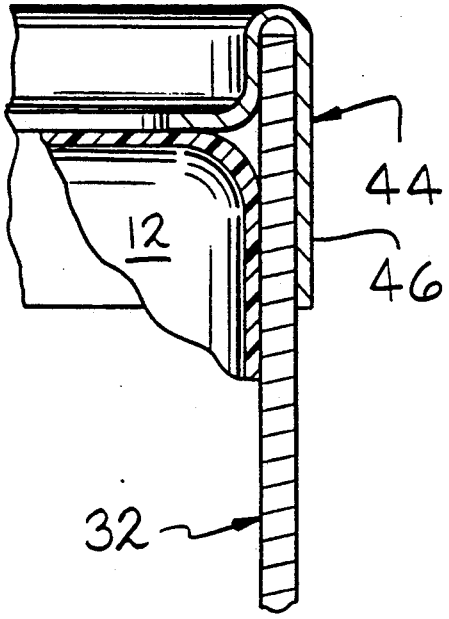
FIG. 5 is a sectional view of a portion of the shipping container of the present invention showing a second embodiment of the top wall engaging a side wall of the outer container.
Figure 6:
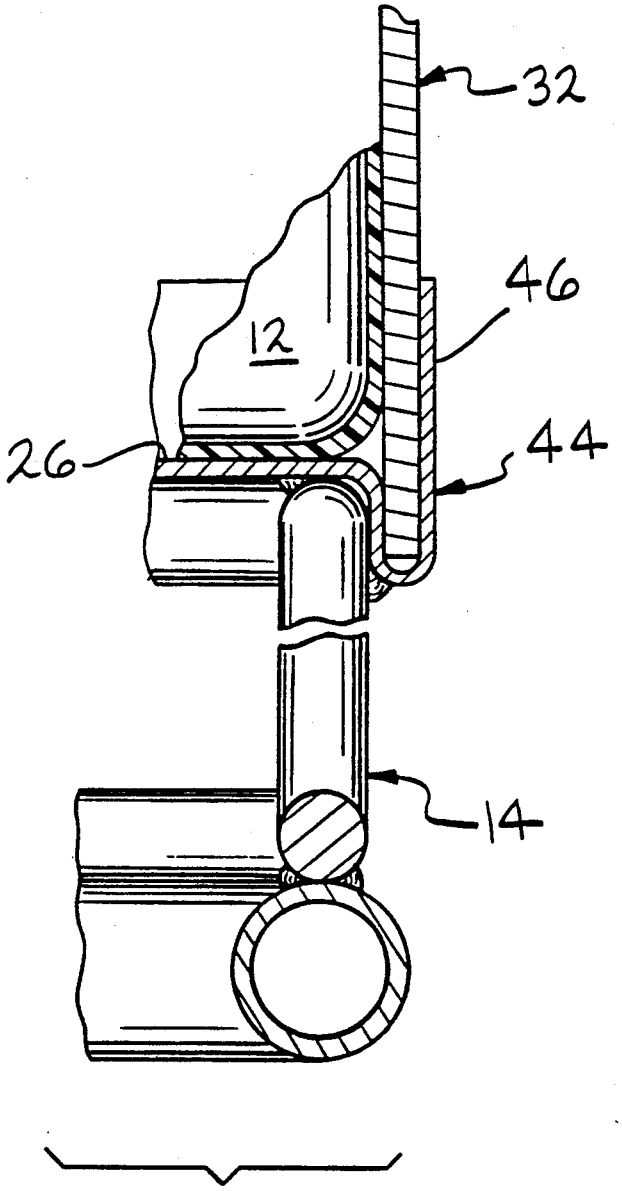
FIG. 6 is a sectional view of a portion of the present invention showing a second embodiment of a side wall being engaged to the bottom member and pallet.

In the alternative embodiment of FIGS. 5 and 6, the T-angle 44 is shown as having the generally upright flange 46 along its perimeter. As the name implies, the T-angle 44 is generally T-shaped in cross-section with the flange 46 forming the cross-bar as seen in FIGS. 5 and 6. A receiving slot 52 is defined by one end of the flange 46 being bent back upon itself to form a generally U-shaped channel at one extreme of the cross-bar. The dimensions of the receiving channel 52 are such that a side wall 32, illustrated as being sheet metal in FIGS. 5 and 6, can be inserted and frictionally retained therein. When it is desirable to stack the composite shipping containers 10, the U-shaped channel in the "T" angle 44, extending upward from the top wall 28, operates as a containing flange encircling the metal pallet 14 positioned therein. If a container 10 having a wooden pallet is to be stacked, the U-shaped channel operates as a supporting surface. In either situation, the "T" angle 44 assists in providing stability to the stacked arraignment.

While the second embodiment is generally illustrated as a T-shape, other structural shapes may also be utilized as well as the side walls 32 may be constructed from other materials. Furthermore, the two embodiments could be combined to provide for an extra measure of retaining force on the side walls 32.

As previously mentioned, the bottom member 30 of the housing 16 may be directly incorporated into the pallet 14 or may be separately attached thereto. For example, if the pallet 14 is constructed of wood and has a wooden support surface 26, the bottom member 30 may form the support surface 26 or may merely be a circumferential member 38, similar to that of the top wall 28, attached along the perimeter of the support surface 26. In the preferred embodiment the pallet 14 is metal and the bottom member 30 is welded thereto to form an integral part of the pallet 14, including as part thereof, the support surface 26.

As apparent from the construction of the preferred embodiments, various aspects of the invention can be utilized to re-manufacture used shipping containers. For example, the "fixed" top of an old shipping container may be cut off allowing the container to be retro-fitted with either the T-angle 44 or bias tab 42 top wall 28 disclosed by this invention. Similar retro-fitting can be done with the bottom member 30 or pallet 14. Additionally, all portions or subassemblies of present composite shipping container 10 can readily be replaced if damaged during use thereby eliminating the need to discard the entire shipping container.

While the above description constitutes the preferred embodiments of the present invention, it will be appreciated that the invention is susceptible to modification, variation and change without departing from the proper scope and fair meaning of the accompanying claims.

I claim:

1. A composite shipping container comprising a removable poly tank, a housing and a pallet, said tank having a top wall, a bottom wall and substantially upright side walls, said top wall being integrally connected to said bottom wall by said tank side walls and also having a fill port positioned in said top wall and a discharge port located adjacent to said bottom wall, said tank being generally enclosed within said housing and supported thereby, said housing including upright side walls in side-by-side contact with said tank side walls and further including a top structure and a bottom structure, said bottom structure being attached to said pallet and being in supportive contact with said tank bottom wall, securing means on said top structure and said bottom structure for releasably retaining said top structure in securement with an upper periphery of said housing side walls and for releasably retaining said bottom structure in securement with a lower periphery of said housing side walls, said securing means being operable to secure said top structure to said upper periphery of said side walls and said bottom structure to said lower periphery of said side walls in response too relative telescoping movement of said top structure in relation to said upper periphery of said side walls and of said bottom structure in relation to said lower periphery.

2. A shipping container as set forth in claim 1 wherein said securing means is integrally formed in said top and bottom structures.

3. A shipping container as set forth in claim 1 wherein said securing means utilizes a snap-fit engagement between said top and bottom structures and said upper and lower peripheries of said housing side walls to interferingly prevent disengagement of said structures and said housing side walls.

4. A shipping container as set forth in claim 1 wherein said securing means includes a plurality of projecting tabs and portions defining a plurality of openings each having an engagement surface for coacting with said tabs to prevent disengagement of said top and bottom structures with said peripheries of said housing side walls.

5. A shipping container as set forth in claim 1 wherein said securing means includes an insertable portion of said side walls and portions defining a receiving slot, said receiving slot frictionally retaining said insertable portion therein in response to relative telescoping movement of said insertable portion and said receiving slot.

6. A shipping container as set forth in claim 4 wherein said tabs are integrally formed on said top and bottom structures and are deflectably projected therefrom.

7. A shipping container as set forth in claim 1 wherein said pallet is formed of tubular metal trusses and said bottom structure is welded thereon.

8. A shipping container comprising a housing and a poly inner tank positioned and supported therein, said tank being of unitary construction and having a bottom wall, a top wall and substantially upright side walls being sufficiently thin so as to be incapable of supporting themselves, a fill port located in said top wall and a discharge port located in one of said side walls adjacent to said bottom wall, said housing including a top, a bottom and substantially upright side walls having upper and lower periphery, attaching means for releasably attaching said housing top to said upper periphery and said housing bottom to said lower periphery thereby enclosing said tank, said attaching means being operative in response to telescoping movement of said housing top and said housing bottom relative to said housing side walls, portions of one of said housing side walls defining an access opening corresponding with said discharge port and said housing top having portions defining an access area permitting access to said fill port.

9. A shipping container as set forth in claim 8 wherein said housing side walls are constructed substantially continuous therearound and employ fastening means for securing said housing side walls into said substantially continuous construction.

10. A shipping container as set forth in claim 8 wherein said housing side walls are formed of wire mesh and include generally criss-crossed members.

11. A shipping container as set forth in claim 8 wherein said attaching means includes portions of said upper and lower periphery and portions of said housing top and bottom being in interference engagement in response to telescoping movement therebetween.

12. A shipping container as set forth in claim 11 wherein said attaching means includes a plurality of biased tabs interferingly engaging said upper periphery with said housing top and said lower periphery with said housing bottom.

13. A shipping container as set forth in claim 12 wherein said biased tabs are integrally formed in said housing top and bottom.

14. A shipping container as set forth in claim 8 wherein said attaching means frictionally retains said housing top and bottom in engagement with said upper and lower periphery,

15. A shipping container as set forth in claim 14 wherein said attaching means includes portions defining a receiving slot in said housing top and bottom, said receiving slot being of a size generally corresponding to housing side walls to thereby receive and frictionally retain said housing side walls therein.

16. A shipping container as set forth in claim 15 wherein said housing top and bottom include periphery being generally T-shaped in cross sectional shape and having said receiving slot defined therein.

17. A shipping container and pallet having a removable inner tank for transporting bulk liquid materials and comprising a base structure having an upper support surface for supporting the tank, a housing including upright side walls having upper and lower periphery, said side walls being supported on said support surface and substantially encircling the tank therein, said housing also including a top in engagement with said upper periphery of said side walls thereby enclosing the tank within said housing, securing means for releasably securing said top to said upper periphery of said side walls and said base structure to said lower periphery of said side walls, said securing means being operable upon telescoping movement of said side walls relative to said top and said base structure, said securing means also being releasable enabling said container to be separated into said top, said side walls and said base structure upon the emptying of the tank.

18. A shipping container and pallet as set forth in claim 17 wherein said support surface includes a plurality of generally upright peripheral flanges being substantially in registry with said lower periphery of said side walls and wherein said top includes generally downwardly extending peripheral flanges being substantially in registry with said upper periphery of said side walls.

19. A shipping container and pallet as set forth in claim 18 wherein said securing means includes a plurality of resilient tabs projecting from said support surface and said top, said tabs interferingly engaging said upper and lower periphery thereby maintaining said side walls in engagement with said top and said base structure.

20. A shipping container and pallet as set forth in claim 19 wherein said tabs project generally angularly inward and downward from said support surface peripheral flanges and angularly inward and upward said top peripheral flanges.

21. A shipping container and pallet as set forth in claim 20 wherein said tabs are integrally formed with said flanges.

22. A shipping container and pallet as set forth in claim 17 wherein said securing means includes portions defining at least one receiving slot adjacent said top and at least one receiving slot adjacent said support surface for telescopingly receiving said upper and lower periphery and frictionally retaining said periphery therein.

23. A shipping container and pallet as set forth in claim 22 wherein said portions defining said slots form peripheral flanges generally circumscribing said top and said support surface.

* * * * *